US006789980B2

(12) United States Patent
Vance et al.

(10) Patent No.: US 6,789,980 B2
(45) Date of Patent: Sep. 14, 2004

(54) DITCH FORMING APPARATUS AND METHOD

(76) Inventors: Thomas L. Vance, 3256 Pins La., Gulf Breeze, FL (US) 32561; Ronald R. Weaver, 3000 Woodbury Cir., Cantonment, FL (US) 32533

( * ) Notice: Subject to any disclaimer, the term of this patent is extended or adjusted under 35 U.S.C. 154(b) by 0 days.

(21) Appl. No.: 09/933,325

(22) Filed: Aug. 20, 2001

(65) Prior Publication Data

US 2003/0035688 A1 Feb. 20, 2003

(51) Int. Cl.[7] ..... E01C 11/22
(52) U.S. Cl. ..... 404/98; 404/110; 404/118
(58) Field of Search ..... 404/98, 96, 110, 404/118, 89

(56) References Cited

U.S. PATENT DOCUMENTS

| | | | | | |
|---|---|---|---|---|---|
| 772,597 | A | * | 10/1904 | Williamson | 404/97 |
| 1,334,483 | A | | 3/1920 | Brooks et al. | |
| 2,094,910 | A | * | 10/1937 | Baily | 404/96 |
| 2,412,398 | A | | 12/1946 | Harsch | 61/63 |
| 2,551,110 | A | * | 5/1951 | Fuller | 409/268 |
| 2,589,634 | A | * | 3/1952 | Shook | 405/268 |
| 2,598,903 | A | * | 6/1952 | Stilwell | 405/268 |
| 2,847,916 | A | | 8/1958 | Andrus et al. | 94/46 |
| 2,999,433 | A | * | 9/1961 | Baltes | 404/96 |
| 3,015,261 | A | | 1/1962 | Mac Donald | 94/46 |
| 3,031,938 | A | | 5/1962 | Beru | 94/46 |
| 3,109,351 | A | | 11/1963 | Dunn | 94/44 |
| 3,130,654 | A | | 4/1964 | Apel et al. | 94/46 |
| 3,566,760 | A | * | 3/1971 | Lafleur et al. | 404/98 |
| 3,606,827 | A | | 9/1971 | Miller et al. | 94/46 |
| 3,767,031 | A | * | 10/1973 | Gorgei et al. | 198/497 |
| 3,936,211 | A | | 2/1976 | Miller et al. | 404/104 |
| 4,013,375 | A | | 3/1977 | Heaton | 404/98 |
| 4,027,990 | A | * | 6/1977 | Merrill | 404/98 |
| 4,093,410 | A | | 6/1978 | Miller | 425/59 |
| 4,197,032 | A | | 4/1980 | Miller | 404/98 |
| 4,217,065 | A | * | 8/1980 | Stilwell | 404/98 |
| 4,287,141 | A | | 9/1981 | Russell | 264/33 |
| 4,319,859 | A | | 3/1982 | Wise | 405/268 |
| 4,360,293 | A | | 11/1982 | Wade | 405/268 |
| 4,379,653 | A | * | 4/1983 | Brown | 404/118 |
| 4,507,012 | A | * | 3/1985 | Corcoran et al. | 404/72 |
| 4,557,633 | A | * | 12/1985 | Dyck | 405/268 |
| 4,828,432 | A | * | 5/1989 | Ives | 405/270 |
| 4,842,441 | A | * | 6/1989 | Watkins | 404/98 |
| 5,080,532 | A | | 1/1992 | Merville et al. | 405/268 |
| 5,641,249 | A | | 6/1997 | McClelland | 405/268 |
| 6,050,744 | A | * | 4/2000 | Binning | 404/108 |

* cited by examiner

*Primary Examiner*—Robert E. Pezzuto
*Assistant Examiner*—Raymond W. Addie
(74) *Attorney, Agent, or Firm*—Peter Loffler

(57) ABSTRACT

A ditch forming apparatus makes the finishing touches on the ground work whereat the ditch is to be formed, pours the concrete, screeds the concrete, and finishes the surface of the concrete. The apparatus uses a hopper with and open top and an open bottom to receive as well as pour the concrete. An extension on the front of the apparatus has a pair of sloped sides joined by a flat bottom making the final shaping of the ground prior to concrete pour. The back edge of the open bottom screeds the concrete while a skid attached to the rear of the apparatus finishes the surface of the poured concrete, the skid having surfaces that are generally parallel with the sides of the extension.

16 Claims, 4 Drawing Sheets

DITCH FORMING APPARATUS AND METHOD

BACKGROUND OF THE INVENTION

1. Field of the Invention

The present invention relates to an apparatus method that form and pave a ditch.

2. Background of the Prior Art

Ditches are used along many roadways to control soil erosion as well as storm water runoff. These ditches are generally concave and tend to be several feet wide. The traditional way to lay ditches is to form the ditch using wood or other similar material, pour the concrete, and have concrete workers screed and thereafter finish the surface of the ditch. This tried and true ditch laying method, although effective, is extremely labor intensive and can result in rapid worker burnout, especially when working on hot days.

In order to overcome the labor intensive nature of ditch laying, several devices have been proposed that lay the ditch relatively automatically. Typically, the concrete is placed into a holding portion of the device, and the concrete is poured and the device performs the screeding and finishing operations. Such prior art devices, which reduce the manual labor aspect of ditch laying, and which perform their intended tasks with varying degrees of efficiency, tend to be very complex in design and construction making them expensive to manufacture as well as to maintain. Additionally, such devices require its crews to have extensive training, which results in high operating costs.

Therefore, there exists a need in the art for a device that can lay a ditch, yet that is not unduly complex in design or operation and is relatively inexpensive to manufacture and maintain. Such a device must be operable by a crew that does not require extensive training in device operation.

SUMMARY OF THE INVENTION

The ditch forming apparatus of the present invention address the aforementioned needs in the art. The apparatus provides a machine that pours concrete, screeds the concrete and leaves the concrete with a finished surface. The ditch forming apparatus is of relatively simple design and construction and is relatively inexpensive to build and maintain. Crews operating the ditch forming apparatus require only modest training in device operation.

The ditch forming apparatus of the present invention is comprised of a hopper that has a front end and a rear end joined by a pair of side members, an outer surface, an inner surface, an open top, and an open bottom. A first frame member is attached to the front end of the hopper, the first frame member having a first pair of wheels attached thereto. A second frame member is attached to the rear end of the hopper, the second frame member having a second pair of wheels attached thereto. An extension extends downwardly from the open bottom proximate the front end, the extension having a pair of sloped side edges joined by a flat bottom edge. A skid is attached to the rear end, the skid having a pair of sloped side surfaces joined by a flat bottom surface. A tongue is attached to the first frame member, the tongue is adapted to be attached to a locomotion device. A first pair of stanchions are slidably attached to the first frame member in spaced apart fashion and are capable of being secured in a fixed position relative to the first frame member, while a second pair of stanchions are slidably attached to the second frame member in spaced apart fashion and are capable of being secured in a fixed position relative to the second frame member. The hopper has an upper section and a lower section wherein the upper section is wider than the lower section so that the open top is larger than the open bottom. At least one brace extends between the front end and the rear end and a chain is attached to the brace. A baffle may be placed into the hopper for reducing the throughput of the concrete within the hopper.

BRIEF DESCRIPTION OF THE DRAWINGS

Similar reference numerals refer to similar parts throughout the several views of the drawings.

DESCRIPTION OF THE PREFERRED EMBODIMENT

Figure 1:
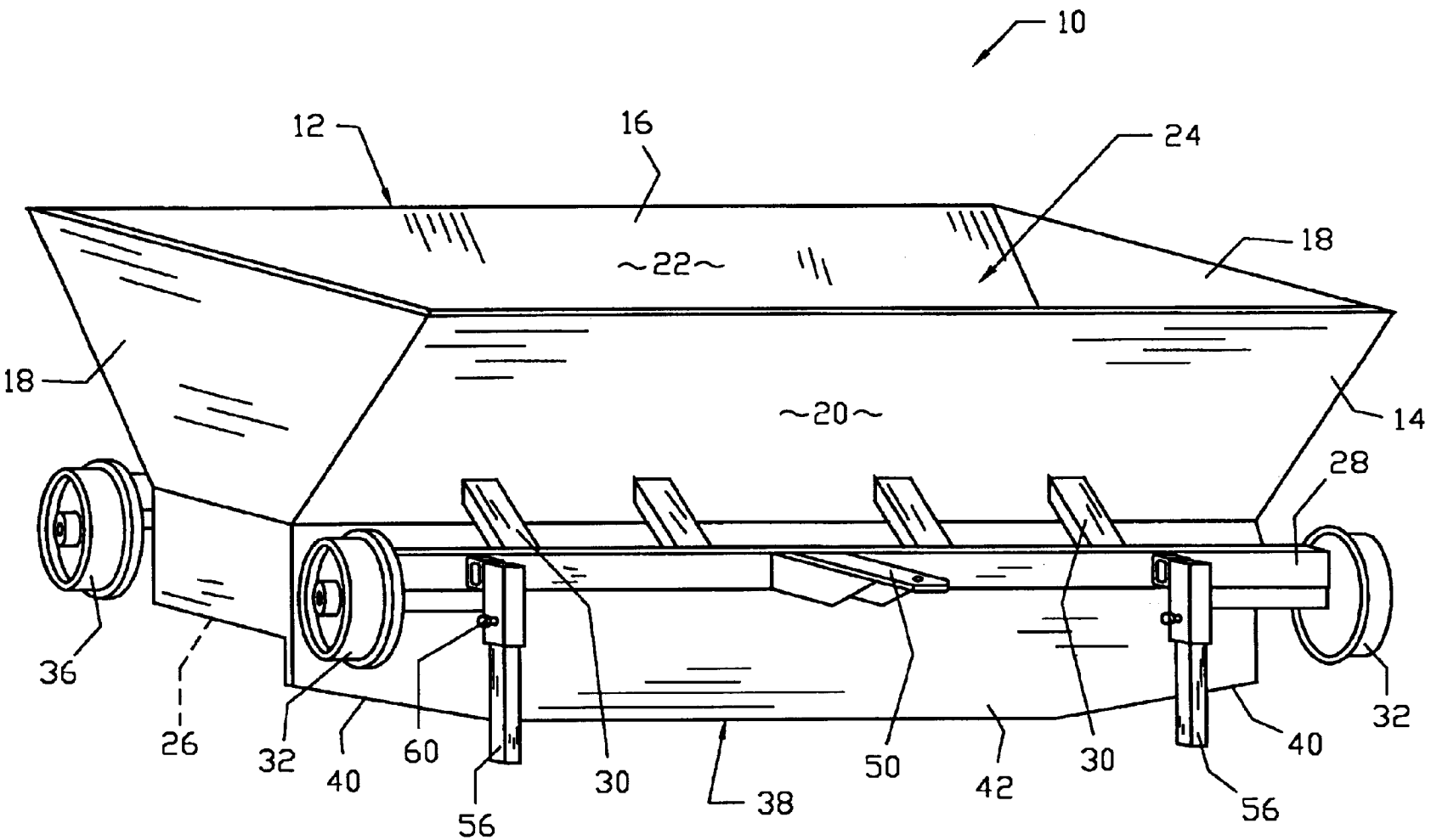
FIG. 1 is a front perspective view of the ditch forming apparatus of the present invention.
Figure 2:
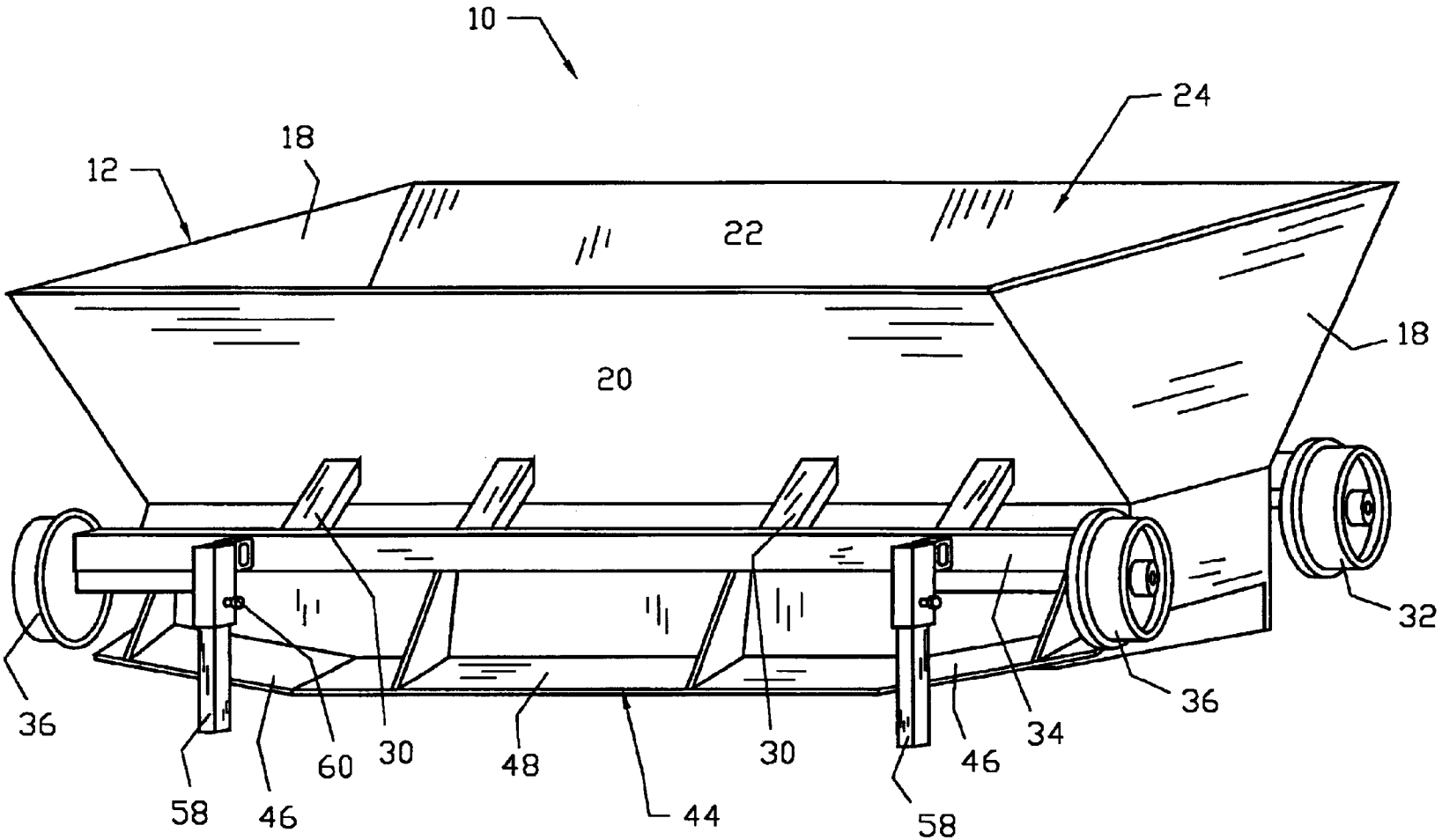
FIG. 2 is a rear perspective view of the ditch forming apparatus of the present invention.
Figure 3:
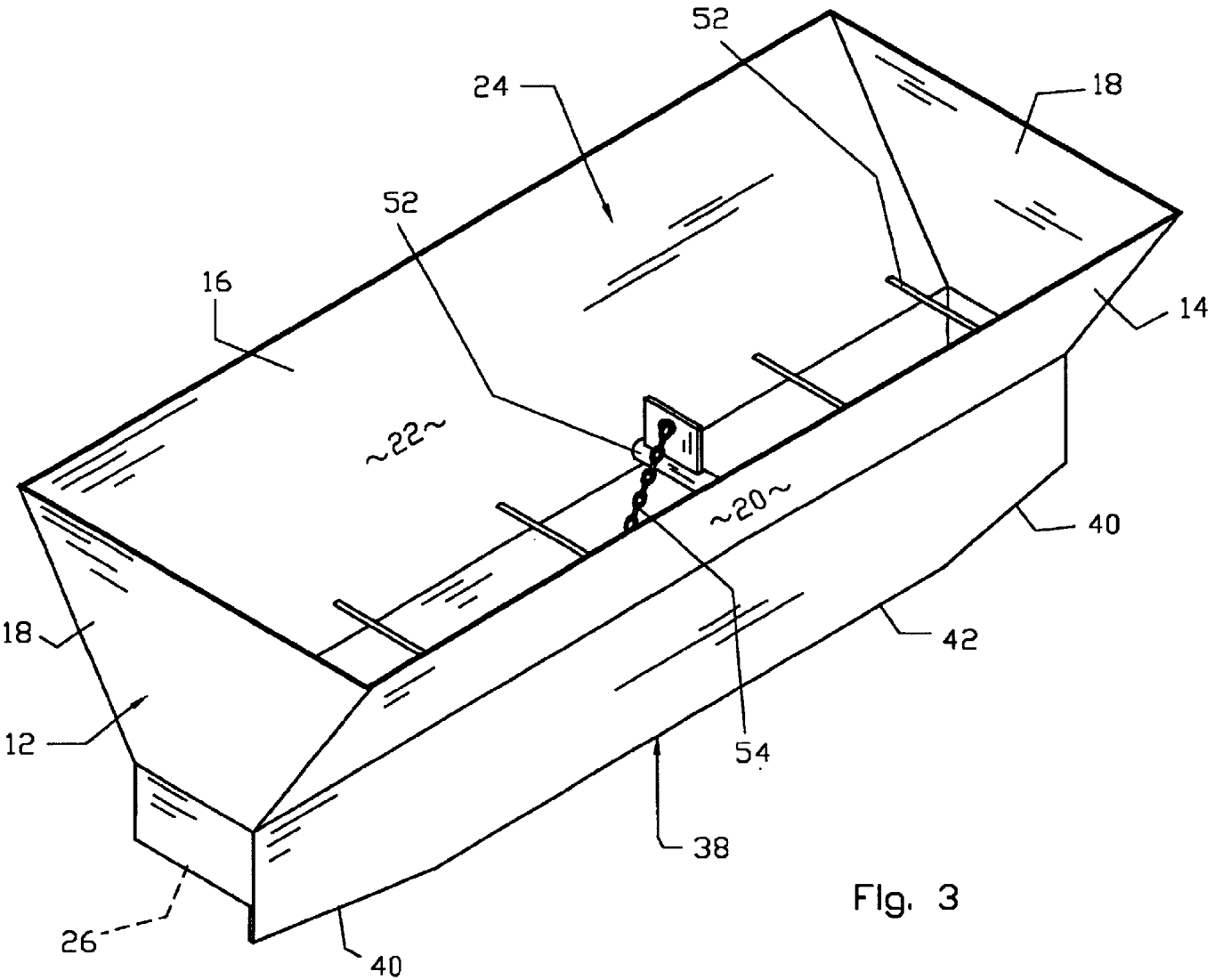
FIG. 3 is a perspective view of the hopper used with the ditch forming apparatus of the present invention.
Figure 4:
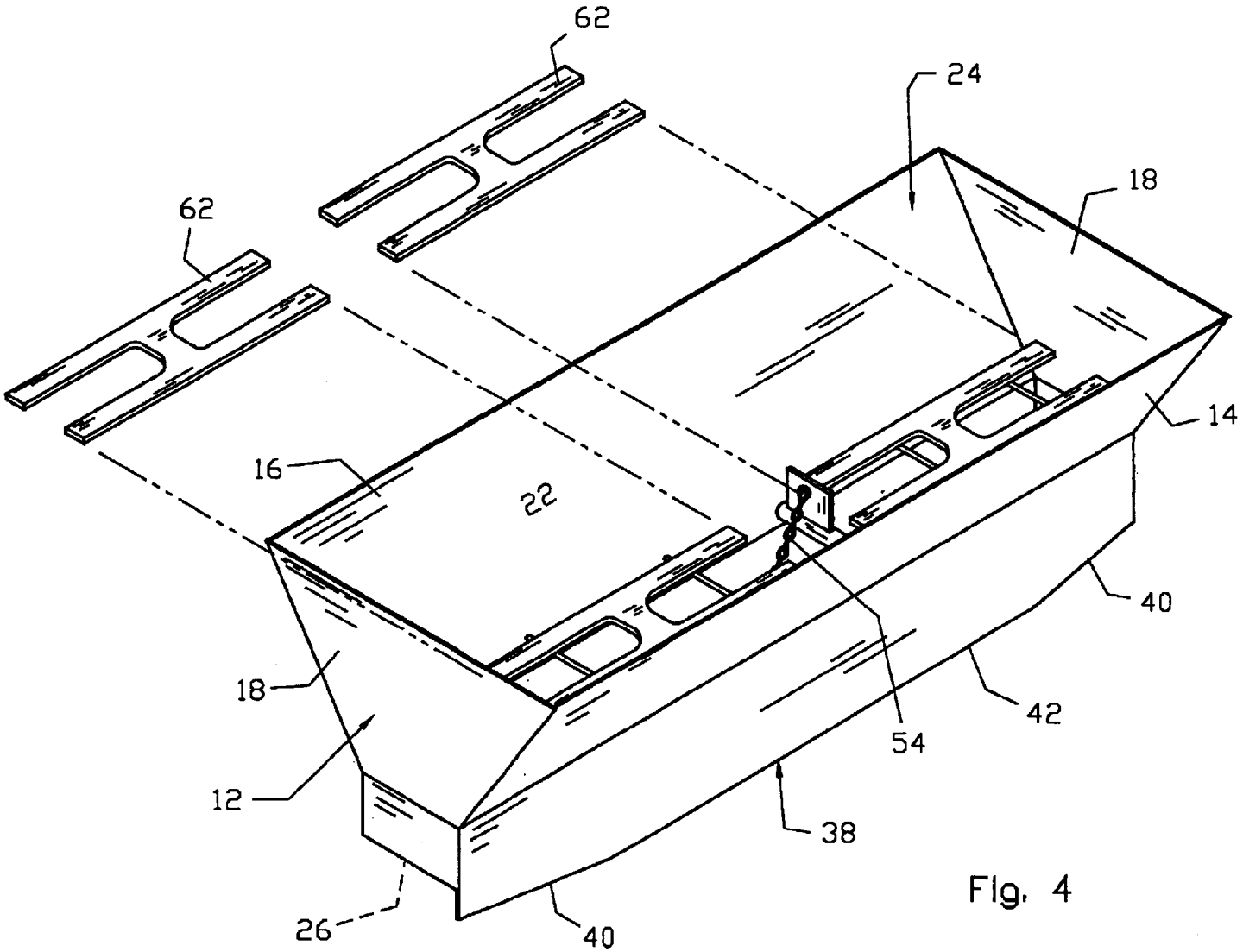
FIG. 4 is a perspective view of the hopper receiving baffles.

Referring now to the drawings, it is seen that the ditch forming apparatus of the present invention, generally denoted by reference numeral 10, is comprised of a hopper 12 that has a front end 14 and a rear end 16 joined by a pair of side members 18, an outer surface 20, an inner surface 22, an open top 24, and an open bottom 26. The hopper 12 has an upper section and a lower section wherein the upper section is wider than the lower section so that the open top 24 is larger than the open bottom 26. A first frame member 28 is attached to the front end 14 of the hopper 12 in any appropriate fashion such as by extending a series of diagonal braces 30 between the first frame member 28 and the front end 14 of the hopper 12. A first pair of wheels 32 is attached to the first frame member 28. A second frame member 34 is attached to the rear end 16 of the hopper 12. The second frame member 34 may also be attached to the hopper 12 by a series of braces 30. A second pair of wheels 36 is attached to the second frame member 34.

An extension 38 extends downwardly from the open bottom 26 proximate the front end 14, the extension 38 having a pair of sloped side edges 40 joined by a flat bottom edge 42. A skid 44 is attached to the rear end 16 of the hopper 12, the skid 44 having a pair of sloping side surfaces 46 joined by a flat bottom surface 48. A tongue 50 is attached to the first frame member 28. At least one brace 52 extends between the front end 14 and the rear end 16 in order to provide structural support for the hopper 12 and a chain 54 is attached to one of these braces 52, the chain being used to lift and lower the apparatus 10 during transport.

A first pair of stanchions 56 is slidably attached to the first frame member 28 while a second pair of stanchions 58 is slidably attached to the second frame member 34 in spaced apart fashion. The first pair of stanchions 56 and the second pair of stanchions 58 are capable of being secured in a fixed position relative to their respective frame members 28 and 34. When the apparatus 10 is not in use, the stanchions 56 and 58 are extended downwardly and held thereat by an appropriate method such as the illustrated pin 60 and the apparatus 10 rests on feet located at the bottom of the stanchions 56 and 58, otherwise, the stanchions 56 and 58 are retracted upwardly so as not to interfere with apparatus operation.

In order to use the ditch forming apparatus 10 of the present invention, the ground whereat the ditch is to be laid is prepared in the usual way and forms are placed on either side of the ditch. The apparatus 10 is positioned such that the first pair of wheels 32 and the second pair of wheels 36 sit on the forms and are capable of riding therealong. The apparatus 10 is attached to a source of locomotion, such as a truck, a tractor, a horse, etc., via the tongue 50. Concrete (or other appropriate ditch forming material) is placed into the hopper 12 through the open top 24 and the apparatus 10 is pulled along the forms via the locomotion device. The extension 38 performs final grading and the concrete is poured into ditch. The back edge of the open bottom 26 performs the screeding operation while the skid 44 finishes the concrete surface. If the concrete is very wet, baffles 62 can be placed into the hopper 12 in order to retard the flow of the concrete through the hopper 12.

While the invention has been particularly shown and described with reference to an embodiment thereof, it will be appreciated by those skilled in the art that various changes in form and detail may be made without departing from the spirit and scope of the invention.

We claim:

1. A ditch forming apparatus comprising:

a hopper having a front end and a rear end joined by a pair of side members, an outer surface, an inner surface, an open top, and an open bottom having an outer periphery that has a front edge that terminates proximate the front end, a first edge that terminates proximate the first side, a rear edge that terminates proximate the rear end, and a second edge that terminates proximate the second side;

a first frame member attached to the front end of the hopper, the first frame member having a first pair of wheels attached thereto;

a second frame member attached to the rear end of the hopper, the second frame member having a second pair of wheels attached thereto;

an extension extending downwardly from the open bottom proximate the front end, the extension having a pair of sloped side edges joined by a flat bottom edge; and a skid attached to the rear end, the skid having a pair of sloped side surfaces joined by a flat bottom surface; and wherein the hopper is adapted to receive concrete therein and deposit the concrete onto the ground through the open bottom such that the extension grades the ground prior to the concrete being deposited and the rear edge of the open bottom screeds the concrete so deposited and the skid slip forms the concrete so screeded.

2. The ditch forming apparatus as in claim 1 further comprising a tongue attached to the first frame member, the tongue adapted to be attached to a locomotion device.

3. The ditch forming apparatus as in claim 1 further comprising:

a first pair of stanchions slidably attached to the first frame member in spaced apart fashion and spaced apart from the first pair of wheels, the first pair of stanchions capable of being secured in a fixed position relative to the first frame member; and a second pair of stanchions slidably attached to the second frame member in spaced apart fashion and spaced apart from the second pair of wheels, the second pair of stanchions capable of being secured in a fixed position relative to the second frame member.

4. The ditch forming apparatus as in claim 1 wherein the open top is larger than the open bottom.

5. The ditch forming apparatus as in claim 1 wherein the hopper has an upper section and a lower section wherein the upper section is wider than the lower section.

6. The ditch forming apparatus as in claim 1 further comprising at least one brace extending between the front end and the rear end.

7. The ditch forming apparatus as in claim 6 further comprising a chain attached to the brace.

8. The ditch forming apparatus as in claim 1 further comprising an H-shaped baffle removably positioned within the hopper in order to retard the flow of the concrete from the hopper through the open bottom.

9. A method of forming a ditch comprising the steps of:

placing a pair of coextensive forms an the ground;

providing a ditch forming apparatus having a hopper having, a front end and a rear end joined by a pair of side members, an outer surface, and inner surface, an open top, an open bottom havina an outer periphery that has a front edge that terminates proximate the front end, a first edge that terminates proximate the first side, a rear edge that terminates proximate the rear end, and a second edge that terminates proximate the second side, a first frame member attached to the front end of the hopper, the first frame member having a first pair of wheels attached thereto and a second frame member attached to the rear of the hopper, the second frame member having a second pair of wheels attached thereto, an extension extending downwardly from the open bottom proximate the front end, the extension having a pair of sloped side edges joined by a flat bottom edge, and a skid attached to the rear end, the skid having a pair of sloped side surfaces joined by a flat bottom surface;

placing the first pair of wheels and the second pair of wheels on the pair of forms;

placing concrete into the hopper; and pulling the ditch forming apparatus along the pair of forms; and wherein the concrete drains from the hopper through the open bottom onto the ground such that the extension grades the ground prior to the concrete being drained onto the ground and the rear edge of the open bottom screeds the concrete so deposited and the skid slip forms the concrete so screeded.

10. The method as in claim 9 wherein the ditch forming machine is pulled via a tongue attached to the first frame member.

11. The method as in claim 9 wherein the ditch forming machine further comprises a first pair of stanchions slidably attached to the first frame member in spaced apart fashion and spaced apart from the first pair of wheels, the first pair of stanchions capable of being secured in a fixed position relative to the first frame member and a second pair of stanchions slidably attached to the second frame member in spaced apart fashion and spaced apart from the second pair of wheels, the second pair of stanchions capable of being secured in a fixed position relative to the second frame member.

12. The method as in claim 9 wherein the open top is larger than the open bottom.

13. The method as in claim 9 wherein the hopper has an upper section and a lower section wherein the upper section is wider than the lower section.

14. The method as in claim 9 wherein the ditch forming machine further comprises at least one brace extending between the front end and the rear end.

15. The method as in claim 14 further comprising a chain attached to the brace.

16. The method as in claim 9 further comprising an H-shaped baffle removably positioned within the hopper in order to retard the flow of the concrete from the hopper through the open bottom.

* * * * *